United States Patent [19]

Slavin et al.

[11] 4,422,522

[45] Dec. 27, 1983

[54] INERTIAL LOCK FOR VEHICLE DOOR LATCH

[75] Inventors: Michael Slavin, Troy; Frank J. Sherosky, Mt. Clemens, both of Mich.

[73] Assignee: Lectron Products, Inc., Rochester, Mich.

[21] Appl. No.: 341,532

[22] Filed: Jan. 21, 1982

[51] Int. Cl.[3] ..... E65B 65/16

[52] U.S. Cl. ..... 180/281; 292/DIG. 22; 292/DIG. 43; 335/253

[58] Field of Search ..... 307/10 R; 335/253, 167, 335/219; 200/52 A, 61.45 M; 292/DIG. 1, DIG. 3, DIG. 5, DIG. 14, DIG. 22, 201, 144, 45; 180/281, 289; 292/DIG. 43

[56] References Cited

U.S. PATENT DOCUMENTS

| | | | |
|---|---|---|---|
| 2,499,727 | 3/1950 | Craig | 292/33 |
| 3,151,698 | 10/1964 | Pollack | 180/281 |
| 3,453,015 | 7/1969 | Miller | 180/281 |
| 3,583,741 | 6/1971 | Breitschwerdt | 180/281 |
| 3,612,207 | 10/1971 | Cabanes et al. | 180/281 |
| 4,132,439 | 1/1979 | Millar | 292/144 |

FOREIGN PATENT DOCUMENTS

| | | | |
|---|---|---|---|
| 2419732 | 11/1975 | Fed. Rep. of Germany | 335/253 |

*Primary Examiner*—David M. Mitchell
*Assistant Examiner*—Pierre Huggins
*Attorney, Agent, or Firm*—Harness, Dickey & Pierce

[57] ABSTRACT

An inertial lock for the electric actuated release mechanism of a door latch, said release mechanism comprising a solenoid and plunger and said inertial lock comprising a spring biased inertial ring disposed on an extended portion of the solenoid and operably associated with spring biased locking tabs operable to lock the plunger in place during conditions which would provide forces that might undesireably actuate the release mechanism, such as certain vehicle accident conditions. This inertial lock is set within the confines of a conventional electric latch release mechanism, not requiring additional space, and features have been incorporated into the design to ease assembly of the electric actuated release mechanism and aid in the collection of flux from the solenoid.

12 Claims, 7 Drawing Figures

INERTIAL LOCK FOR VEHICLE DOOR LATCH

BACKGROUND AND SUMMARY OF THE INVENTION

This invention relates generally to locking devices, and more particularly to an automotive deck lid or fifth door locking mechanism including a remotely operable, electric release therefor.

The locking mechanism of the subject invention is comprised of a conventional striker cam having a latch formed at one end, and a cooperable actuating lever or detent member having a first position for retaining the latch in a closed position relative to a striker bolt and a second position for releasing the latch. In the subject invention an electric actuator is provided for releasing the deck lid or fifth door in response to energizing a solenoid, the solenoid including a plunger having a first end drivingly connected to the actuating lever and a second end slidably located and supported in the solenoid. By energizing the solenoid, a magnetic field is produced to displace the plunger inwardly within a bore of a bobbin carrying the windings.

Automotive vehicles presently are cutting down weight in order to improve fuel economy. As part of this weight reduction, the frame of the vehicle has fewer structural members and in some cases no structural members below the sheet metal other than the door frames and window frames. All structural members that provide rigidity to the vehicle body are removed in the weight reduction process. If a vehicle door opens in accident conditions, the vehicle is highly subject to collapse if rolled over in any way. The doors of the vehicle are relied upon to maintain structural stability to the body in a roll-over condition.

If the vehicle is in an accident, the armature of the solenoid in an electric lock release may be actuated due to inertia as the vehicle is acted upon by centrifugal force or other forces and may release to unlatch a door. To prevent collapse of the car, the car door, and in particular the door latch, must remain closed. It has been estimated that the door must remain latched under up to 30 g's of force, and such a requirement is included in at least one manufacturers specification. Therefore, one object of the subject invention is to provide a locking mechanism having a latch securely retained in its closed position by an inertial mechanism responsive to centrifugal forces similar to those encountered in accident conditions. It is also an object of the invention to provide this inertial locking mechanism without obstructing any normal operating procedures of the latch mechanism, nor altering these normal operating procedures in normal conditions in any way.

As vehicles get smaller in the pursuit of weight reduction for improved fuel economy, less space is permitted for the provision of a lock and a lock release mechanism for deck lid or the fifth door of the vehicle. It is a further object of the subject invention to provide a lock and lock release mechanism which may be contained in the same confined space utilized by conventional locking arrangements thereby making the subject device adaptable for use as original equipment on new automobiles, or, conversely, as a replacement item on old vehicles, and still provide the inertial locking mechanism responsive to forces similar to those encountered in accident conditions.

It is a still further object of the subject invention to provide a trunk lock and release mechanism which may be manually operated by a key or by remote control under all extremes of pressure exerted on the trunk lid, such extremes including variations in production tolerances and variations in temperature, except under accident conditions when the inertial locking mechanism controls.

It is yet a further object of the subject invention to provide a novel remote control lock release mechanism therefor which is simple in construction, economical to manufacture, efficient in operation, and free from external influences (tamper-proof).

Another object of the present invention is to provide all of the above advantages while also providing a purpose to the inertial locking mechanism in normal operating conditions of the vehicle door latch to act as a flux collector for the solenoid.

Other advantages of the present invention will become apparent from a consideration of the following detailed description taken in conjunction with the accompanying drawings.

BRIEF DESCRIPTION OF THE DRAWINGS

FIG. 6 is a fragmentary longitudinal sectional view similar to FIG. 5 but showing the locking device in its normal inoperative position and the solenoid plunger in the latch releasing position to which it is moved under normal vehicle operating conditions when the solenoid is energized; and FIG. 7 is a fragmentary, longitudinal sectional view similar to FIG. 5 but showing the inertial locking device positioned to restrain the solenoid plunger so as to prevent movement of the latter and inadvertent release of the latch mechanism under inertial forces created under certain abnormal vehicle operating conditions such as a skid or other accident for example.

DETAILED DESCRIPTION OF THE PREFERRED EMBODIMENT

Figures 1, 2, 3:
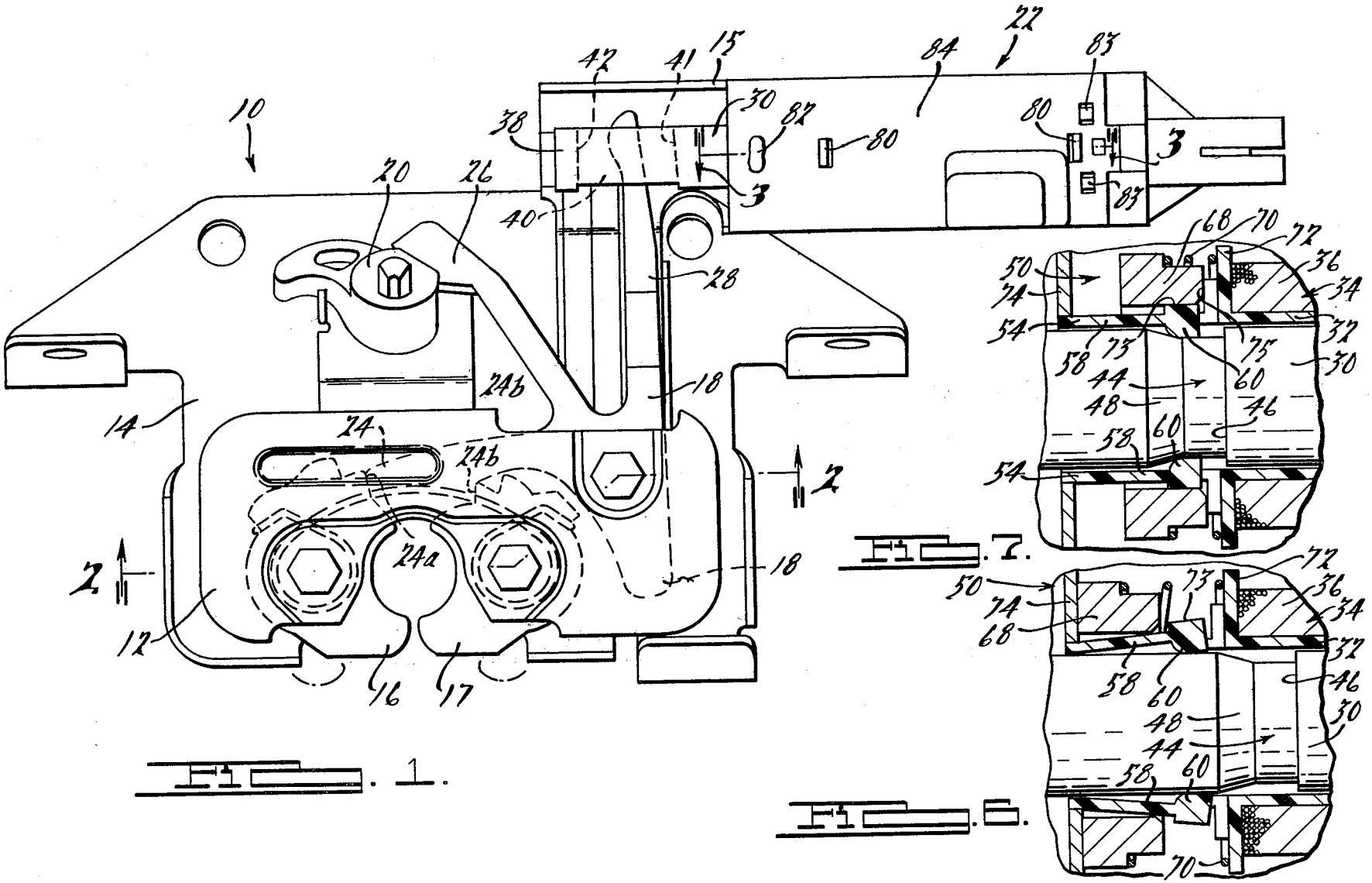
FIG. 1 is an enlarged plan view of a solenoid operated latch mechanism incorporating the inertial locking device of this invention and showing the latch in the locked position.
FIG. 2 is a longitudinal sectional view of the latch mechanism illustrated in FIG. 1 taken along the line 2—2 thereof.
FIG. 3 is a fragmentary, longitudinal sectional view taken substantially along the line 3—3 of FIG. 1.
Figure 2:
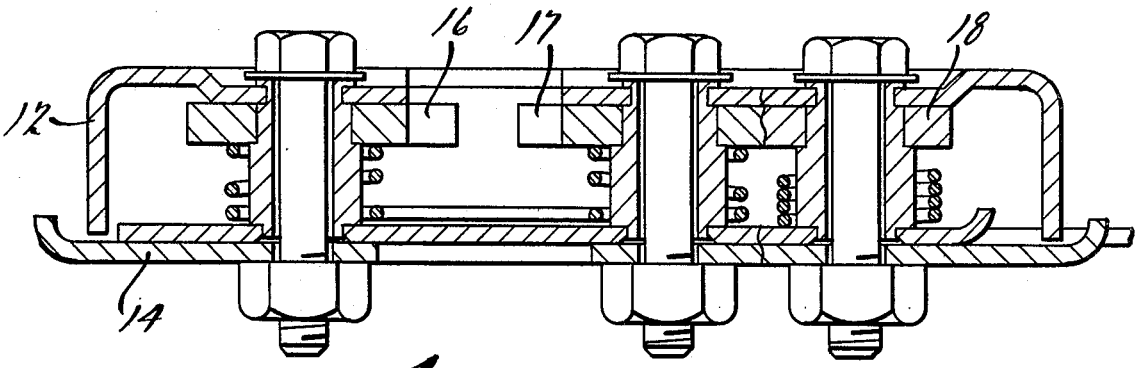
Figure 3:
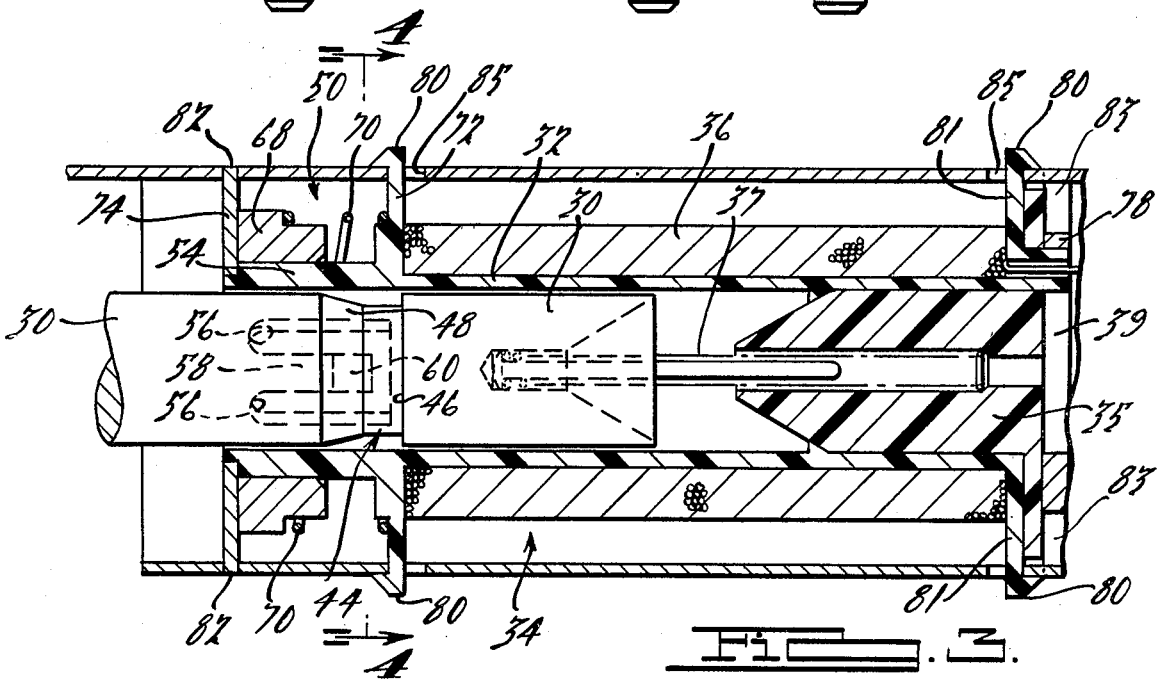
Figure 4:
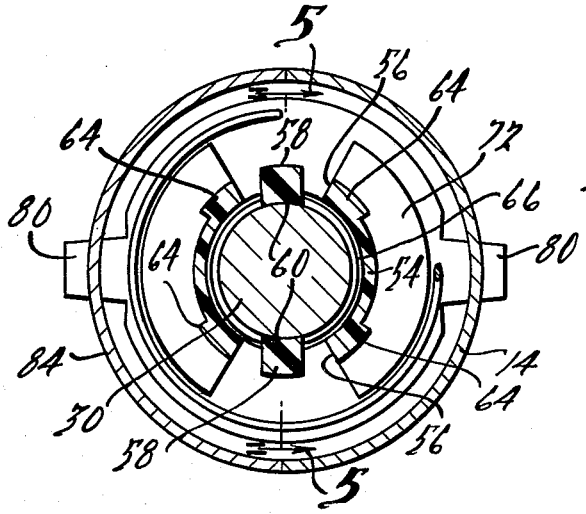
FIG. 4 is a transverse sectional view taken on the line 4—4 of FIG. 3 but turned 90°.

With reference now to FIG. 1 of the drawings, the numeral 10 designates a conventional latch mechanism for mounting on the fifth door of an automotive vehicle. The particular latch mechanism here shown by way of example is a conventional type having an upper cover or enclosure member 12 associated with a mounting plate or base portion 14, a pair of striker cams or latch members 16 and 17 that are normally spring biased to the open position, a catch cam or detent member 18, and key cam member 20, all of the members being pivotally supported by and between the base 14 and the cover 12. When the door on which the latch mechanism is mounted is slammed shut, the latch members 16 and 17 engage a latch pin (not shown) on the vehicle body or frame and are rocked on their mounting pivots by such engagement to close around the latch pin and hold the door closed. The latch mechanism 10 is manually operated to release the door in a conventional manner by means of a key actuated locking cylinder (not shown), the locking cylinder being operatively associated with the key cam 20. Additionally, the mechanism 10 may be operated from a remote location such as the instrument panel of the vehicle to open the door automatically from the interior of the vehicle. In the illustrated embodiment, automatic release is accomplished by a solenoid assembly 22 which is drivingly connected to the detent member 18 and integrally connected to the base 14 at the upper right hand corner 15 thereof as viewed in FIG. 1.

The detent member 18 has three operating arms 24, 26 and 28 and is spring biased in a counterclockwise direction, as viewed in FIG. 1, to position a lateral extension on the arm 24 between facing shoulders or abutments on the latch members 16 and 17 when the latter close around the latch pin so as to hold the latch members engaged with the pin and the door closed. The middle operating arm 26 is associated with the key cam 20. The third operating arm 28 has a driven connection with the solenoid assembly 22. The construction and operation of the latch mechanism 10 is conventional and need not be described in greater detail except perhaps to note that the latch members 16 and 17 can be released or opened either manually by a key which turns the key cam 20 against the detent arm 26 or electrically by energization of the solenoid assembly 22 to move the operating arm 28 to the right in FIG. 1 in a manner to be hereinafter described.

FIG. 3 illustrates the internal construction of the solenoid assembly 22 in detail. More specifically, the metal armature 30 is moved axially to the right in the hollow tubular bobbin 32 of the solenoid 34 by a magnetic field produced when the winding 36 on the bobbin 32 is energized by an electric current. The bobbin 32 can be made of any suitable material but it preferably is made of glass filled (30%) nylon which provides the necessary electrically non conductive characteristics as well as an antifriction property which is desirable for reasons that will hereinafter be apparent.

According to the present invention, a longitudinal extension 38 (FIG. 1) on one end of the armature 30 is provided with an elongate slot 40 which receives the operating arm 28 of the detent member 18. A spring 37 confined between the inner end of the armature 30 and an end plug 35 in the end of the bobbin 32 (FIG. 3) biases the armature normally to the left as viewed in FIG. 1 so that the arm 28 normally occupies a position at or adjacent to the right or inner end 41 of the slot 40. As a consequence, the slot 40 permits substantial free travel of the armature 30 when the solenoid is energized before the outer end 42 of the slot strikes the arm 28. As a result of this free travel or lost motion, the armature 30 builds up considerable speed before it strikes the arm 28 and the inertial force thus generated compounds with the electromagnetic force created by the solenoid winding 36 to cause the armature to strike the arm 28 with relatively great force. Thus, even though the armature 30 has a relatively short travel, its impact force on the operating arm 28 is sufficient to assure release of the striker cams 16 and 17 by the latch arm 24.

The armature 30 has an annular groove 44 at an intermediate location longitudinally inwardly of but adjacent to the slot 40, and the groove has a substantially right angle profile 46 at the side of the groove remote from the armature extension 38 and a long tapered profile 48 on the side of the groove adjacent to the extension 38.

Figure 5:
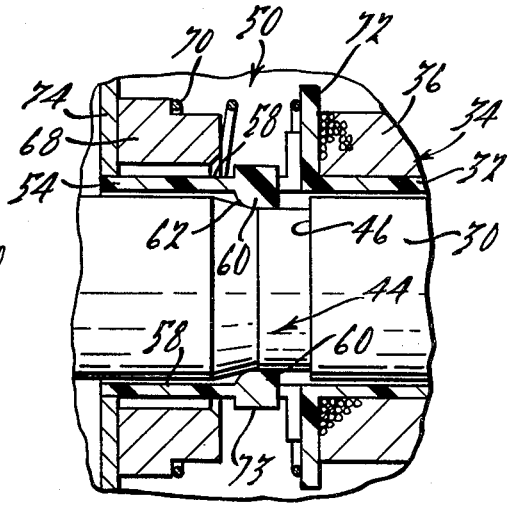
FIG. 5 is a fragmentary, longitudinal sectional view taken on the line 5—5 of FIG. 4 and showing the normal position of the locking device and its relation to the solenoid plunger when the solenoid that operates the latch mechanism is deenergized.

Reference is now had to FIGS. 3–7 which show details of the inertial locking mechanism 50 of the present invention. The solenoid bobbin 32 is provided at the end thereof adjacent to the latch mechanism 10 with a longitudinal tubular extension 54 which has longitudinally elongate apertures 56 formed therein at diametrically opposite sides thereof. As perhaps best shown in FIG. 3, flexible arms 58 preferably formed integrally or in one piece with the extension 54, project longitudinally in the apertures 56 midway between the sides thereof from the axial outer ends of the apertures to points adjacent to but short of the axial inner ends of the apertures; and radially inwardly projecting locking tabs or flanges 60 on the free ends of the arms 58 extend into the bobbin sufficiently to enter the annular armature groove 44 as shown in FIG. 5 when the arms are relaxed or unflexed and the armature 30 is positioned longitudinally in the bobbin as it normally is when the solenoid 22 is deenergized. However, the axially outwardly facing ends of the flanges 60 are tapered or convexly rounded, as at 62, so that in normal operation they ride easily over or along the tapered surface 48 of the armature groove 44 to the position shown in FIG. 6 when the armature 30 is moved to the right by energization of the winding 36 to release the latch members 16 and 17.

A plurality (here shown as four) of longitudinally extending, circumferentially spaced ribs or rails 64 are provided on the outer periphery 66 of the bobbin extension, and an inertial locking ring 68 is mounted on the bobbin extension for longitudinal sliding movement on the ribs which provide for relatively frictionless travel of the ring. A relatively light spring 70 behind the ring 68 keeps the latter normally positioned at or adjacent to the outer end of the bobbin extension 54 and against a metal flux collector disk 74 mounted on the extension at the outer end thereof. In the latter position of the ring 68, it is spaced longitudinally away from the free ends of the arms 58 so that the latter are free to flex radially outwardly as shown in FIG. 6 as the locking flanges 60 ride over the tapered surface 48 of the armature as the latter is moved axially to release the latch 10 by energization of the solenoid coil 36. In this connection, it will be observed (FIGS. 5 and 6) that substantial radial clearance is provided between the arms 58 and the inertial ring 68 by the ribs 64 to assure free unobstructed radial flexure of the arms so long as the ring is kept in its normal inoperative position by the spring 70. When the armature 30 is moved to the latch releasing direction in normal operation of the solenoid 22, the groove 44 and thereby the armature 30, is not restricted in such movement by the arms 58 and the tapered surface portion 48 of the groove easily pushes the flanges 58 radially outwardly to allow the armature 30 to move freely and easily axially in both directions. However, when the armature 30 is in its normal position to the left (FIG. 1) with the locking flanges 60 accommodated within the groove 44 (FIG. 5), the inertial ring 68 is free to slide back and forth on the bobbin extension 54 against the action of the spring 70 between its normal position against the flux collector disk 74 (FIG. 6) and a radial shoulder 75 on the bobbin flange 72 (FIG. 7). In the extreme right hand position shown in FIG. 7, the inertial ring 68 surrounds and overlays raised lands 73 formed on the free ends of the arms 58 directly radially outwardly of the locking flanges 60. When the arms 58 are in their normal relaxed, unflexed condition, as they are when the locking flanges 60 are accommodated in the groove 44, the external diameter of the bobbin extension 54 at the lands 73 is approximately the same or slightly less than the internal diameter of the ring 68. In any event, however, the conditions are such that the inertial ring 68 is free sliding under the conditions specified and it has unobstructed movement to the extreme right hand position shown in FIG. 7, and when so positioned the ring positively prevents outward flexing of the arms 58 with the result that locking flanges 60 cannot ride over the tapered groove surface 48 but are confined to the groove 44 to hold the armature 30 securely against axial movement and consequently to prevent release of the latch mechanism 10.

Under crash conditions, inertial forces to which the latch operating mechanism, and particularly the solenoid 22, is subjected may sometimes cause the armature to move axially with sufficient force to release the latch members 16 and 17 all without electrical energization of the winding 36. This exposes the occupants of the vehicle to extreme danger particularly if the vehicle is the type having a fifth rear door—a type with which the latch is specially designed to be used—since these vehicles have a relatively light and weak body frame structure and depend to a considerable extent on the latch to hold the body rigid in use.

The inertial lock device of this invention is uniquely adapted for use with any solenoid actuated door latch mechanism for automotive vehicles and is operative, under the crash conditions referred to, to hold the solenoid armature securely during the time it is subjected to the destructive inertial forces. It does this positively and automatically. Moreover, once the crises is past, the inertial lock device releases the armature and returns to its normal inoperative status or condition. It does this also automatically and with certainty.

More particularly, the inertial locking ring 68 moves in the same direction as the armature 30 when both are subjected to centrifugal forces tending to release the latch members 16 and 17, but the ring moves with less frictional force opposing it so that it gets to the right hand position overlying the lands 73 and locking flanges 60 (FIG. 7) before the armature 30 can move the annular groove 44 out from under the flanges. Consequently, the inertial locking ring 68 prevents the locking flanges 60 from riding out of the groove when the armature 30 does try to move and thus locks the armature 30 in place until the centrifugal forces have subsided and thus keeps the vehicle door from unlatching. It has been calculated that centrifugal forces in the order of 30 g's are developed under crash conditions, and the armature begins to move under these forces at about 5 g's. However, the inertial ring 68 moves between its extreme positions left to right (FIGS. 5 and 7) at about 3 g's. Consequently, the locking ring 68 always locks the armature before the latter has a chance to move. The ribs 64 on which the locking ring 68 rides are important not only because they reduce the friction opposing the movement of the ring, but because they also permit the bobbin 32 to be formed of a suitable plastic material and thus reasonably guarantee a circular cross section of the tubular extension 54. Thus, the locking ring 68 is essentially free floating. The spring 70 moves the locking ring 68 away from its locking condition (FIG. 7 to FIG. 5) to its normal position as soon as the rapid force change having a component of movement along the axis of the plunger 30 is dissipated. It will thus be apparent that the present invention provides the objective of extreme reliability and precise, uniform and instant locking of the solenoid armature 30 without unduly adding to the cost of the solenoid assembly 22. In this latter connection, it should perhaps be noted that it is not commercially practicable to solve the problem involved here by simply using a heavier spring 37 since this would require a much larger coil 36 which in turn would increase the cost of the solenoid assembly so much that it would no longer be competitive in the market place.

To facilitate assembly of the solenoid 22 on the mounting plate 14, the latter is provided with spaced apertures 85 which receive and interlock with snap finger tabs 80 at the ends of radial flanges 72 and 81 on the bobbin 32. The flanges 72 and 81 are disposed in parallel relation to the staking lugs 82 and 83 on the flux collector disks 74 and 78, respectively, that normally hold and position the solenoid assembly 22 properly in the housing 14. After assembly, however, the snap finger tabs 80 are no longer functional to the unit. In practice, the solenoid cover 84 is temporarily retained and the internal components are temporarily held in position at assembly by the snap tabs 80 that extend through and interengage with aligned openings 85 in the mounting plate and the cover. Then, the staking fingers 82 and 83 on the metal flux collector disks are peened over to secure the parts permanently together.

If the inertial locking ring 68 is made of a ferrous material, it also serves as a flux collector and thus supplements the flux collecting function of the disk 74. While it will be apparent that the preferred embodiment of the subject invention disclosed herein is well calculated to fulfill the objects above stated, the invention is susceptible to modification, variation and change without departing from the proper scope or fair meaning of the subjoined claims.

I claim:

1. A vehicle door latch locking mechanism having a solenoid actuator for releasing said latch, said actuator including a bobbin and an armature movable axially in said bobbin and having in combination therewith means for temporarily locking said armature against axial movement in said bobbin comprising stop means on and movable axially with said armature, flexible members on said bobbin having detent means thereon normally movable radially into and out of the path of movement of said stop means, locking means movable in response to inertial forces occurring as the result of an accident during vehicle operation coactive with said flexible members to hold said detent means in the path of said stop means to restrain movement of said armature, and means for normally positioning said locking means in relation to said flexible members to permit movement of said armature in at least one direction.

2. A locking mechanism for a vehicle door latch comprising electrically actuated means for releasing said door latch including a solenoid having an axially movable armature, and means operable in response to inertial forces occurring during accident conditions of the vehicle for disabling said solenoid including means forming a radial shoulder on and movable with said armature, stop means normally disposed in the path of travel of said shoulder and engageable therewith to limit movement of said armature in one direction, flexible members carrying said stop means normally positioning the same to engage said shoulder but normally operative by said armature to move said stop means out of the path of travel of said shoulder, means for preventing movement of said stop means out of the path of travel of said shoulder including an inertial locking member coactive with said flexible members, and support means mounting said locking member for movement between a first position in which it permits free flexure of said flexible members and a second position in which it engages said flexible members to prevent movement of said stop means out of the path of travel of said shoulder, spring means for holding said locking member normally in said first position, said locking member being operative in response to inertial forces occurring in use under said accident conditions to move from said first position to said second position, and spring means coactive with said locking member for returning the latter to said first position when said inertial forces acting on said locking member are reduced.

3. The mechanism recited in claim 2, wherein said locking member is axially slidable, and wherein the axis of movement of said locking member and said axis of movement of said armature are parallel.

4. The mechanism recited in claim 2, wherein said locking member is axially slidable, and wherein the axis of movement of said locking ring and the axis of movement of said armature are coincident.

5. A locking mechanism for a vehicle door latch comprising electrical actuation means for releasing said door latch comprising a solenoid mechanism including a bobbin and a plunger movably disposed within said bobbin along an axis of movement, means for temporarily disabling said electical actuation means by locking said plunger within said bobbin, said disabling means being engageable with said plunger to prevent latch releasing movement thereof in said bobbin in response to inertial forces having a component of force along the axis of movement of said plunger resulting from rapid changes in the direction of movement of the vehicle and being more rapidly responsive to said inertial forces than said plunger, whereby said plunger is locked by said disabling means before said plunger has time to release said latch.

6. A mechanism in accordance with claim 5, wherein said disabling means includes spring biased actuator means, spring biased locking means, and means for minimizing friction forces opposing movement of said spring biased actuator means.

7. A mechanism in accordance with claim 6, wherein said spring biased actuator means comprises a coil spring and a ring movably associated with and biased by said spring.

8. A mechanism in accordance with claim 7, wherein said means for minimizing friction forces comprises a plurality of rails on which said ring is slidably disposed.

9. A mechanism in accordance with claim 8, wherein said bobbin has an extended portion and said rails are disposed on said extended portion.

10. A locking mechanism for a vehicle door latch comprising electrically actuated means for releasing said door latch, including solenoid means comprising a plunger and a bobbin, said bobbin having at least one radially outwardly extending flange, windings disposed adjacent to and at one side of said flange, and a portion extending from said flange in a direction away from said windings, and said plunger being slidably and actuatably displaceable within said bobbin along its axis, and means for locking said electrically actuated releasing means in response to inertial forces having a component along the axis of movement of the plunger created by movement of the vehicle, said locking means including actuator means slidably mounted on said extending portion of said bobbin.

11. A mechanism in accordance with claim 10, further comprising a housing in which both said electrically actuated releasing means and said locking means are disposed, said housing including a base portion, a cover member, and staking means for properly aligning said cover member with said base portion and for collecting flux from said solenoid means upon electrical actuation of said releasing means, wherein said actuator means is in the form of a metal ring operative in at least one position thereof to coact with said staking means in collecting flux from said solenoid means.

12. A mechanism in accordance with claim 11, wherein said flange of said bobbin further includes radially outwardly extending fastener tabs, wherein said base portion and said cover member have apertures therein, wherein said fastener tabs are disposed in said apertures and are operative to hold said base portion, said cover member and said releasing means initially together at assembly.

* * * * *